US008842407B2

(12) United States Patent
Cortinovis et al.

(10) Patent No.: US 8,842,407 B2
(45) Date of Patent: Sep. 23, 2014

(54) MEDIUM VOLTAGE CIRCUIT BREAKER

(75) Inventors: Gianluca Cortinovis, Albino (IT); Giorgio Moriconi, Torre Boldone (IT)

(73) Assignee: ABB Technology AG, Zurich (CH)

( * ) Notice: Subject to any disclaimer, the term of this patent is extended or adjusted under 35 U.S.C. 154(b) by 154 days.

(21) Appl. No.: 13/522,615

(22) PCT Filed: Dec. 13, 2010

(86) PCT No.: PCT/EP2010/069478
§ 371 (c)(1),
(2), (4) Date: Jul. 17, 2012

(87) PCT Pub. No.: WO2011/085887
PCT Pub. Date: Jul. 21, 2011

(65) Prior Publication Data

US 2012/0320487 A1 Dec. 20, 2012

(30) Foreign Application Priority Data

Jan. 18, 2010 (EP) ..... 10150948

(51) Int. Cl.

| | |
|---|---|
| ***H01H 73/00*** | (2006.01) |
| ***H01R 13/504*** | (2006.01) |
| ***H01H 33/666*** | (2006.01) |
| *H01H 33/662* | (2006.01) |
| *H01H 33/02* | (2006.01) |
| *H01H 3/30* | (2006.01) |

(52) U.S. Cl.
CPC ..... *H01H 33/666* (2013.01); *H01R 13/504* (2013.01); *H01H 2033/6623* (2013.01); *H01H 33/022* (2013.01); *H01H 3/30* (2013.01)
USPC ..... 361/115

(58) Field of Classification Search
USPC ..... 361/115
See application file for complete search history.

(56) References Cited

U.S. PATENT DOCUMENTS

| | | | | |
|---|---|---|---|---|
| 4,025,883 | A * | 5/1977 | Slade et al. | 335/16 |
| 4,360,857 | A * | 11/1982 | Olashaw | 361/648 |
| 6,373,358 | B1 * | 4/2002 | Davies et al. | 335/202 |
| 6,930,271 | B1 * | 8/2005 | Palmieri et al. | 218/154 |
| 7,201,595 | B1 | 4/2007 | Morello | |
| 7,719,823 | B2 * | 5/2010 | Josten et al. | 361/611 |
| 2007/0253124 | A1 * | 11/2007 | Zhou et al. | 361/2 |
| 2008/0296137 | A1 * | 12/2008 | Chen et al. | 200/400 |
| 2010/0018570 | A1 * | 1/2010 | Cashion et al. | 136/246 |

FOREIGN PATENT DOCUMENTS

| | | | |
|---|---|---|---|
| EP | 0681352 | A2 | 11/1995 |
| EP | 1626425 | A1 | 2/2006 |

* cited by examiner

*Primary Examiner* — Scott Bauer
(74) *Attorney, Agent, or Firm* — Novak Druce Connolly Bove + Quigg LLP

(57) ABSTRACT

A Medium Voltage circuit breaker which comprises an insulating base frame supporting: a pole assembly having, for each phase, an interruption unit housing a fixed contact and a movable contact reciprocally couplable/uncouplable between an open and a closed position; an actuator to actuate the opening and closing operation of said circuit breaker; and, a control and diagnostic unit comprising a control box having a casing housing a plurality of accessory devices of said circuit breaker.

10 Claims, 7 Drawing Sheets

MEDIUM VOLTAGE CIRCUIT BREAKER

CROSS REFERENCE TO RELATED APPLICATIONS

This application is a National Phase filing under 35 U.S.C. §371 of PCT/EP2010/069478 filed on Dec. 13, 2010; and this application claims priority to Application No. 10150948.7 filed in Europe on Jan. 18, 2010 under 35 U.S.C. §119; the entire contents of all are hereby incorporated by reference.

The present invention relates to a medium voltage circuit breaker with improved features, and in particular to a medium voltage circuit breaker comprising an integrated control and diagnostic unit. For the purposes of the present application the term medium voltage is referred to applications in the range of between 1 and 52 kV.

Medium voltage circuit breaker are well known in the art. They usually consist of a pole assembly having, for each phase, a fixed contact and a movable contact. This latter is typically movable between a first position, in which it is coupled to the fixed contact, and a second position, in which it is uncoupled from said fixed contact, thereby realizing the opening and closing operation of the circuit breaker.

The pole assembly is usually mounted on a base frame which is generally made of many separate components of metallic material, assembled by screws and/or welding. An actuator, for actuating the opening and closing operation of the circuit breaker, and a kinematic chain, linking the actuators to the movable contacts, are usually also mounted onto the base frame.

Medium voltage circuit breakers usually also comprises a number of auxiliary devices aimed at carrying out auxiliary functions for the circuit breaker. Such auxiliary functions normally includes a number of coils for the opening, closing, trip, shunt, undervoltage or blocking operation.

Other auxiliary functions that need to be performed in a medium voltage circuit breaker are the spring charging operation of the actuator device for the mechanical operated circuit breaker. Also, auxiliary contacts are normally foreseen in order to detect the status of the main contacts of the circuit breaker. Still a further auxiliary equipment is the control system for the motor of the truck for circuit breakers in withdrawable configurations.

In addition, for each operation (e.g. shunt, tripping, undervoltage, block released, etc.) a dedicated coil, operating under a predefined voltage is normally required.

The usual assembly processes of the circuit breaker, normally foresee a number of steps in which some of the components of the frame are assembled before mounting the actuator, poles and kinematic chain, while some others components of the frame are assembled after the actuator, poles and kinematic chain have been mounted.

Typically the auxiliary devices are separately assembled on the medium voltage circuit breaker, in the sense that each of them is separately mounted on the circuit breaker on the main assembly line thereof. Alternatively, they are prepared in three main subgroups (namely: auxiliary contacts, coils, and spring charging motor) and then assembled to the circuit breaker and separately wired to the main control system.

The known production processes of medium voltage circuit breakers are therefore long and complicated, both in terms of number of components and require manpower for the assembly operations.

It is therefore an object of the present invention to provide a medium voltage circuit breaker in which the above-mentioned drawbacks are avoided or at least reduced.

More in particular, it is an object of the present invention to provide a medium voltage circuit breaker whose production process is greatly simplified with respect to the conventional circuit breaker.

As a further object, the present invention is aimed at providing a medium voltage circuit breaker having a reduced number of mechanical parts.

A further object of the present invention is to provide a medium voltage circuit breaker that does not need complicated wiring operation in the assembly phase.

Still a further object of the present invention is to provide a medium voltage circuit breaker in which the various subcomponents of the circuit breaker (e.g. pole assembly, actuator, auxiliary devices) can be pre-assembled and tested outside the main production line of the circuit breaker.

Still another object of the present invention is to provide a medium voltage circuit breaker in which the auxiliary devices of the circuit breaker can be pre-assembled and pre-tested outside the main production line of the circuit breaker.

Another object of the present invention to provide a medium voltage circuit breaker in which the number of coils can be reduced.

Still another object of the present invention is to provide a medium voltage circuit breaker with reduced manufacturing, installation and maintenance costs.

Thus, the present invention relates to a medium voltage circuit breaker which is characterized in that it comprises an insulating base frame supporting:

- a pole assembly having, for each phase, an interruption unit housing a fixed contact and a movable contact reciprocally couplable/uncouplable between an open and a closed position;
- an actuator to actuate the opening and closing operation of said circuit breaker; and,
- a control and diagnostic unit comprising a control box having a casing housing a plurality of accessory devices of said circuit breaker.

In this way, it is possible to overcome some of the disadvantages and drawbacks of the circuit breaker of the known art.

In particular, the use of an insulating base frame for supporting the pole assembly and said actuator allows to greatly simplify the production process of the circuit breaker. In practice, all components of the circuit breaker (pole assembly, actuator, kinematic chain, possible auxiliary equipment) can be pre-assembled separately and then fixed in one step to the insulating base frame, which is preferably made in one single piece.

Even more important, the auxiliary components (e.g., auxiliary contacts, coils, and spring charging motor) can be pre-assembled into the control box and pre-tested before assembling to the circuit breaker in the main assembly line.

Preferably, in the Medium Voltage circuit breaker according to the invention the control box comprises an insulated casing for housing said plurality of accessory devices and a cover couplable to said insulated casing.

According to a preferred embodiment, said control box comprises co-moulded wirings for plug-in connection of said plurality of accessory devices.

In addition, the control box advantageously comprises at least a co-moulded connection of the plug-socket type for connection to said circuit breaker.

In such a case, the insulating base frame comprises at least a co-moulded connection of the plug-socket type for connecting to a corresponding plug-socket connection of said control box.

In order to realize a direct operative also with the actuator, said control box comprises a mechanical connection with said actuator.

Advantageously, said control box comprises a local human machine interface for signaling the status and/or malfunctioning conditions of said circuit breaker.

In the case the control box comprises an insulated casing for housing said plurality of accessory devices and a cover couplable to said insulated casing, said local human machine interface is positioned on said cover of said control box.

A typical configuration of a medium voltage circuit breaker according to the invention, said auxiliary devices comprises one or more coils and/or one or more pairs of auxiliary contacts and/or a spring charging motor.

In the above mentioned case, said coils comprises one or more of the following coils: opening, closing, shunt, undervoltage or blocking coils.

A preferred embodiment of the medium voltage circuit breaker according to the invention, foresees that at least one of said coils is able to run with different voltages and perform different functions.

Preferably, said control box comprises a removable portion comprising an electronic board including diagnostic and control electronics. In this way it is possible to perform a number of control and diagnostic operation that will be explained in more details in the following description.

Further characteristics and advantages of the invention will emerge from the description of preferred, but not exclusive embodiments of a medium voltage circuit breaker according to the invention, non-limiting examples of which are provided in the attached drawings, wherein.

Figure 1:
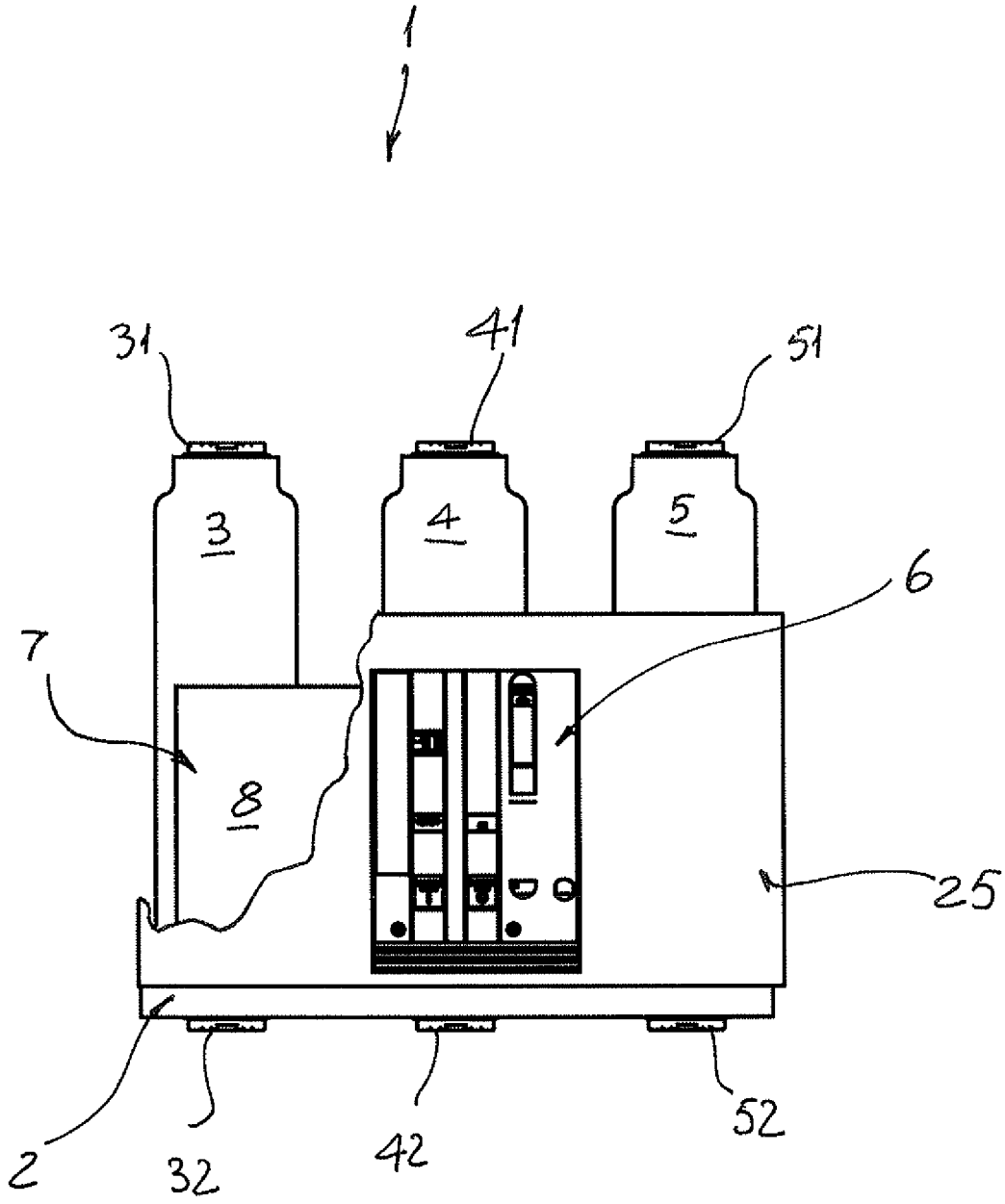
FIG. 1 is a schematic front view of a first embodiment of a medium voltage circuit breaker according to the invention, with a partial cut-out part.

With reference to the attached figures, a medium voltage circuit breaker according to the invention, designed with the reference number 1, in its more general definition, comprises an insulating base frame 2, which is conveniently made in one piece of insulating material.

The insulating base frame 2 supports a pole assembly having, for each phase, an interruption unit housing a fixed contact and a movable contact reciprocally couplable/uncouplable between an open and a closed position (fixed and movable contacts are not shown in the attached drawings).

Normally the circuit breaker 1 is a three-phase circuit breaker and thus comprises three interruption units 3, 4, and 5 which house corresponding sets of fixed/movable contacts reciprocally couplable/uncouplable between an open and closed position. Fixed and movable contacts can be conventional contacts of known type and therefore will not be described in more details.

Electrical connection of the circuit breaker 1 with the power plant usually comprises, for each phase, connection plugs 31, 41 and 51 directly connected to the interruption units 3, 4, and 5, as well as connection plugs 32, 42 and 52 that can be fixed onto the insulating base frame 2 and electrically connected with the corresponding interruption units 3, 4, and 5.

The circuit breaker according to the invention further comprises an actuator 6 to actuate the opening and closing operation of said circuit breaker. The actuator 6 normally comprises an actuating mechanism connected to the movable contact assembly through a kinematic chain (not shown). For the purposes of the present invention, the actuator can be a conventional actuator of known type and therefore will not be described in more details, being known per se.

One of the characterizing features of the medium voltage circuit breaker 1 of the present invention is that said circuit breaker comprises a control and diagnostic unit 7 which conveniently comprises a control box 8.

The control box 8 substantially consists of a casing 81 which houses a plurality of accessory devices 50, 51, 52, 53, 54, 55 and 86 of said circuit breaker 1.

Thus, the medium voltage circuit breaker 1 of the invention has the great advantage that all auxiliaries, or at least a good number of them, are grouped together inside the casing 81 of the control box 8. The whole assembly of the control box 8 can therefore be pre-assembled and pre-tested before being positioned in the insulating base frame 2, together with the interruption units 3, 4, and 5, the actuator 6 and the kinematic chain, with a consistent reduction of production times and costs.

Figure 2:
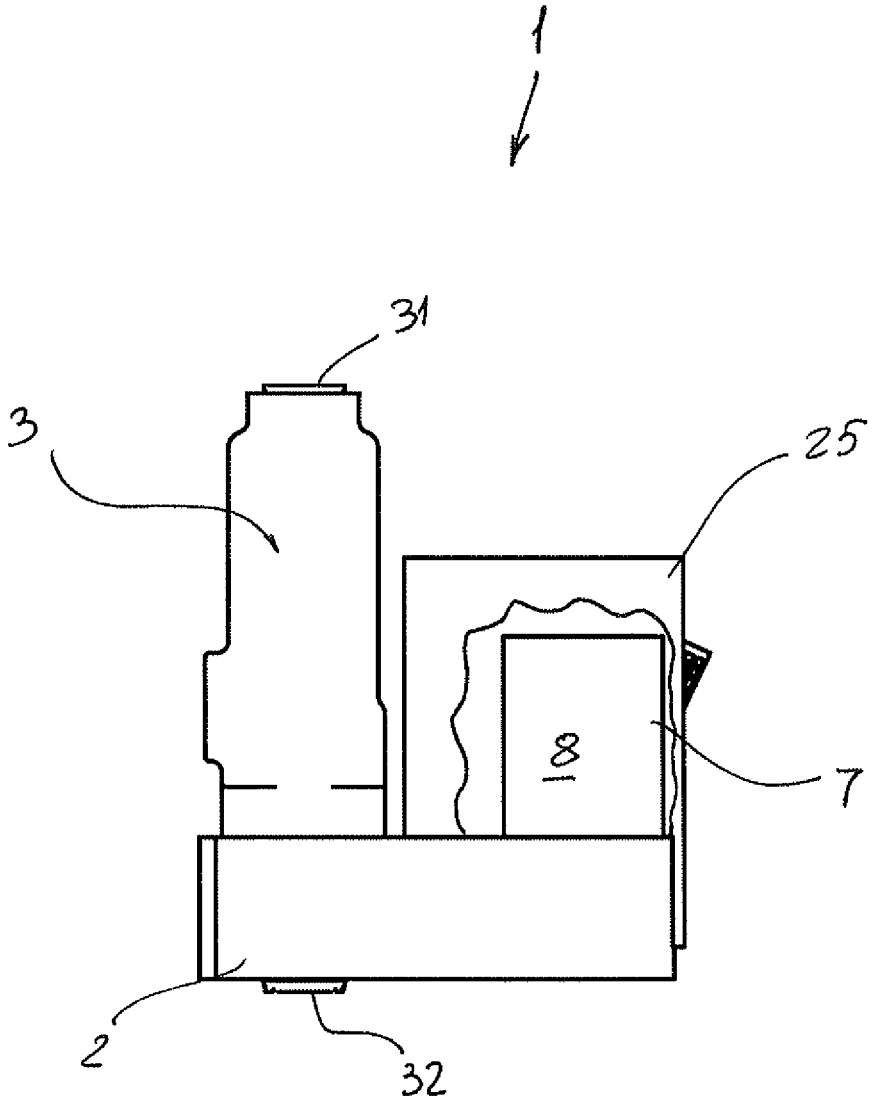
FIG. 2 is a schematic side view of the medium voltage circuit breaker of FIG. 1, with a partial cut-out par.
Figure 3:
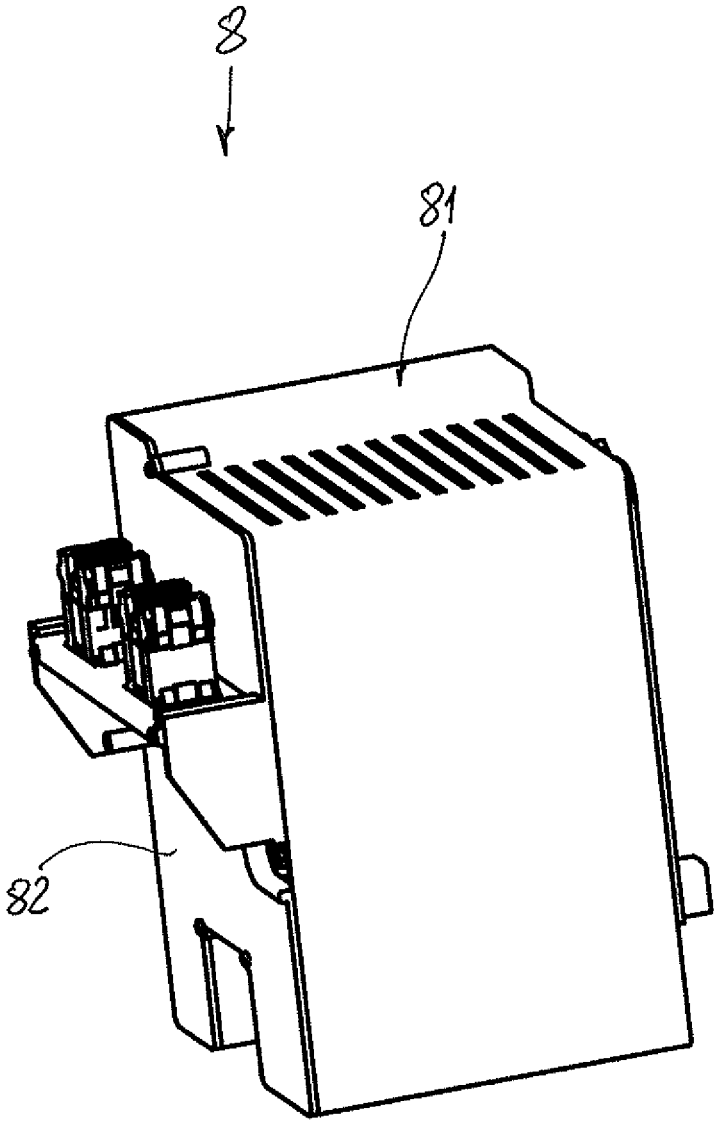
FIG. 3 is a perspective view of a first embodiment of a control box of a medium voltage circuit breaker according to the invention.
Figure 4:
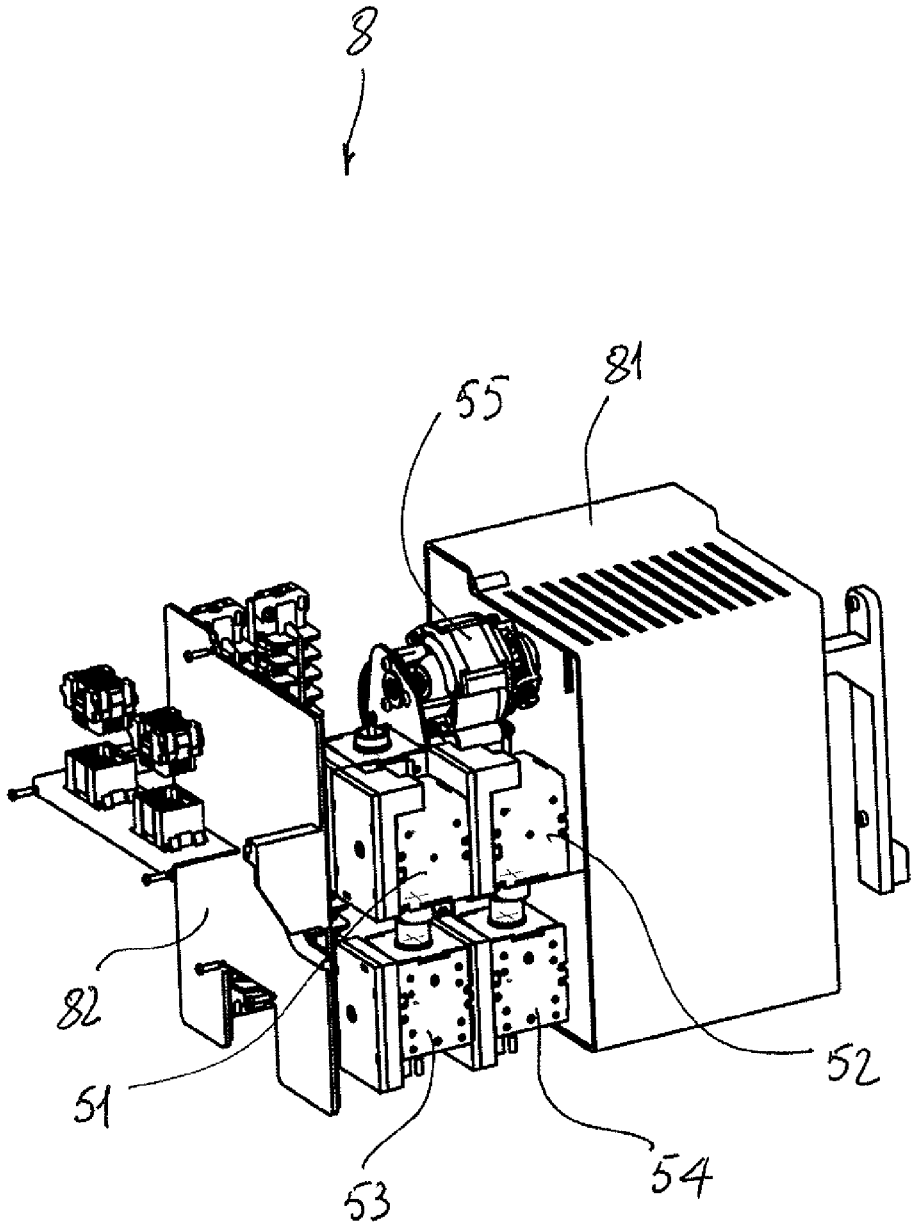
FIG. 4 is an exploded perspective view of the control box of FIG. 3.

Preferably, as shown in FIGS. 1 and 2, the control box 8, the actuating mechanism of the actuator 6 and the kinematic chain can be conveniently covered by a casing 25 which is mechanically coupled (e.g. by clipping) to the insulating base frame 2. In the above mentioned figures, the casing 25 has been partially cut-out in order to show the positioning of the control box 8 onto the insulating base frame 2

With reference to FIGS. 3 to 8, preferred embodiments of the medium voltage circuit breaker 1 of the invention foresee that the control box 8 comprises an insulated casing 81 for housing said plurality of accessory devices 50, 51, 52, 53, 54, 55 and 86; the control box 8 then further comprises a cover 82 which is couplable to said insulated casing 81, in order to realize an enclosed environment.

In order to minimize the assembly procedures, the control box 8 conveniently comprises co-moulded wirings for plug-in connection of said plurality of accessory devices 50, 51, 52, 53, 54, 55 and 86. In practice, instead of having to separately wire the auxiliary devices 50, 51, 52, 53, 54, 55 and 86, the wirings and the connections thereof can be pre-arranged in the control box by, e.g. co-moulding the wirings and the connections. Then the auxiliary devices 50, 51, 52, 53, 54, 55 and 86 can be simply and quickly plugged-in into the corresponding connections in the control box 8.

Preferably, in order to make quicker and simpler also the electrical connection of the control box 8 with the circuit breaker 1, said control box 8 can conveniently comprise at least a co-moulded connection of the plug-socket type for connection to said circuit breaker 1. In practice, a connection, e.g. a socket, can be prearranged on the control box 8, said socket being couplable with a corresponding plug on the circuit breaker side. It is also possible to have plug connection pre-arranged on the control box 8, said plug being couplable with a corresponding socket on the circuit breaker side Preferably, in order to further minimize the assembly procedures of the medium voltage circuit breaker 1 of the invention, said insulating base frame 2 comprises a pre-arranged connection, e.g. at least a co-moulded connection of the plug-socket type for connecting to the above-mentioned corresponding plug-socket connection pre-arranged on said control box 8.

In addition to the mechanical fixing of the control box 8 onto the insulating base frame 2 and the electrical connection thereof with the circuit breaker, the control box 8 can conveniently comprise also a mechanical connection 50 with said actuator 6. As an example, said mechanical connection can be used for transmitting motion between one of the auxiliary devices (e.g. a spring charging motor) and the actuator 6 or to detect parameters of the main operating shaft of the actuator, e.g. position and/or speed and/or acceleration of the main operating shaft.

In a preferred embodiment of the medium voltage circuit breaker 1 according to the invention, said control box 8 advantageously comprises a local human machine interface 63 for signaling the status and/or malfunctioning conditions of said circuit breaker 1. For instance, the local human machine interface 63 can consist of a number of LEDs properly positioned on the exterior of the control box 8 so as to be visible by a user.

Figure 5:
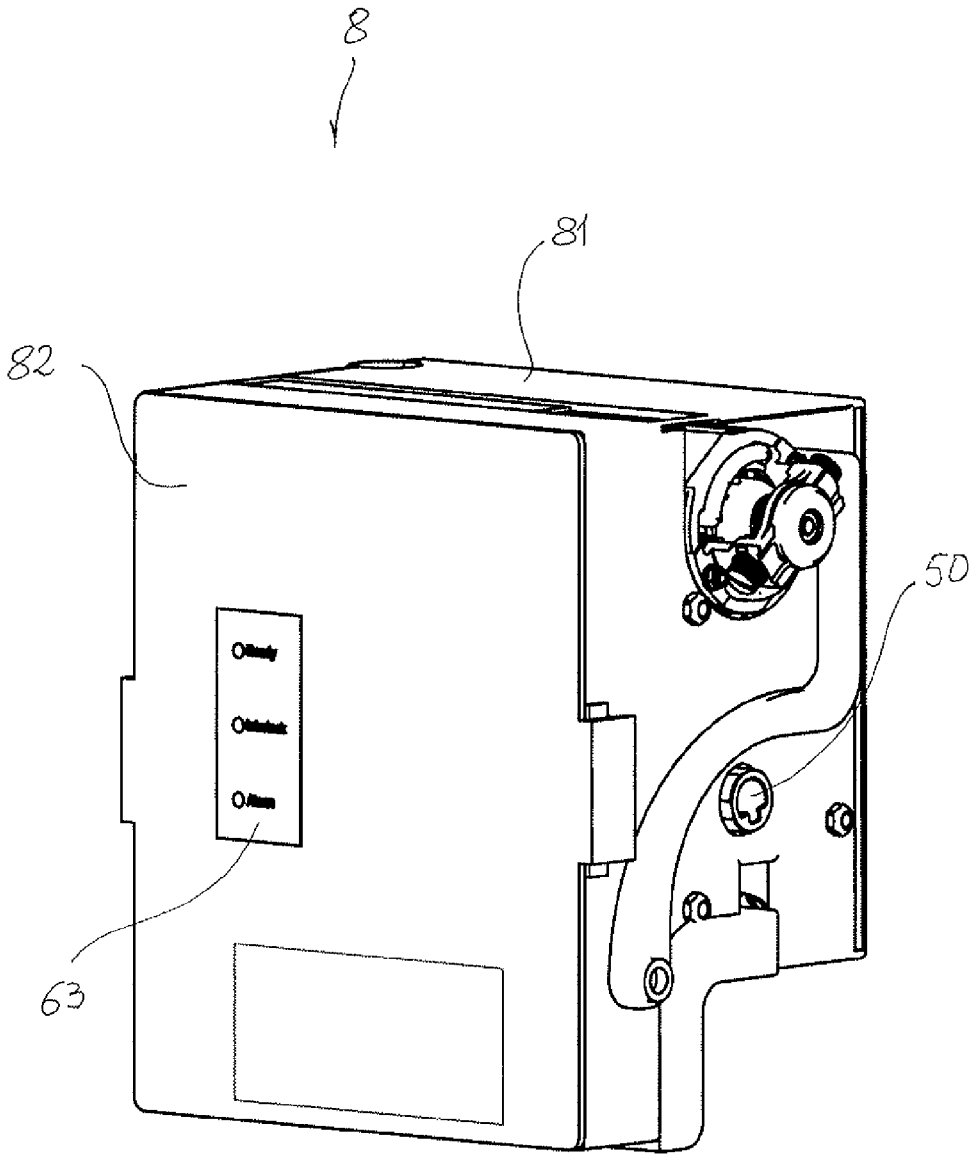
FIG. 5 is a perspective view of a second embodiment of a control box of a medium voltage circuit breaker according to the invention.
Figure 6:
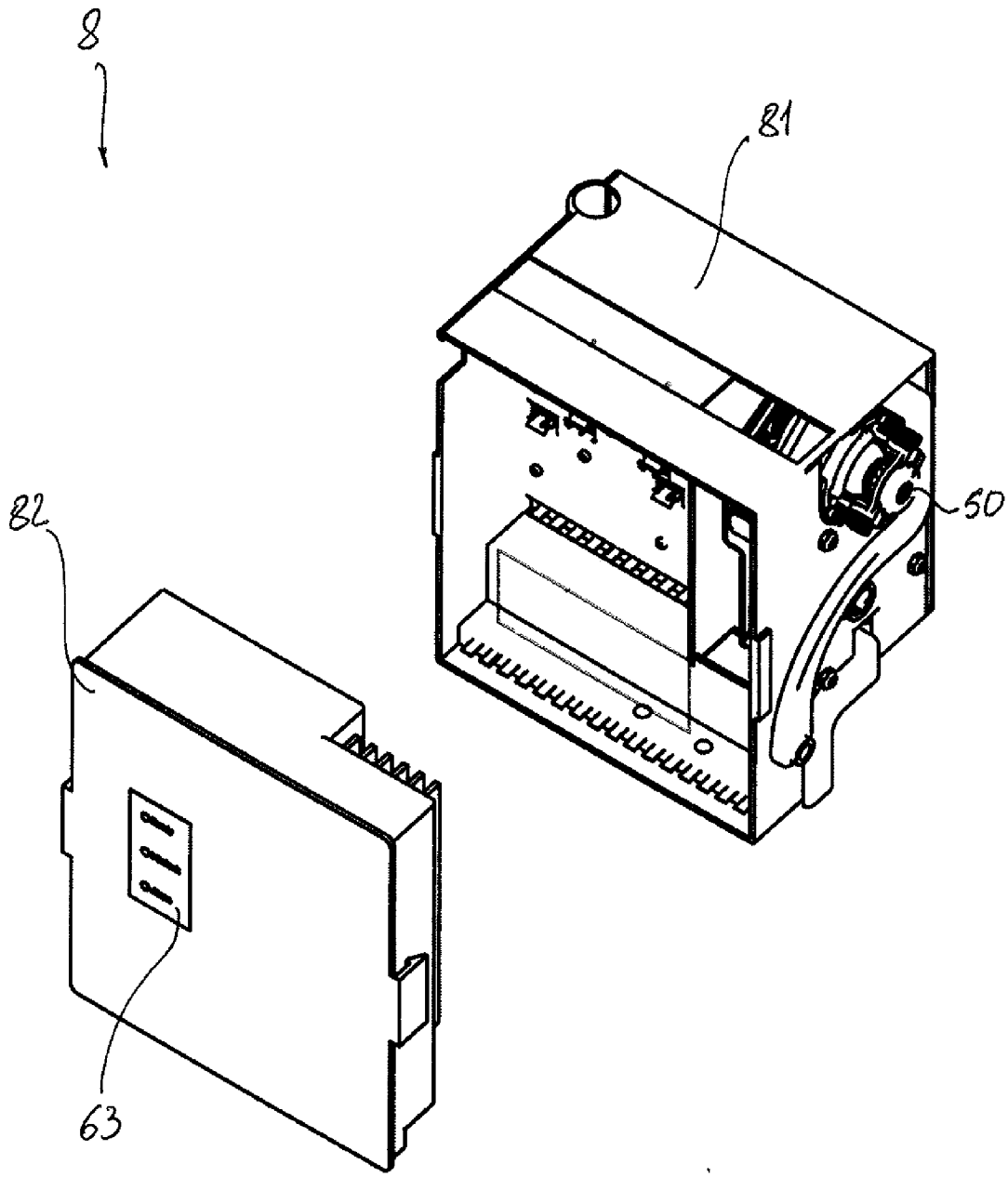
FIG. 6 is a first exploded perspective view of the control box of FIG. 5.
Figure 7:
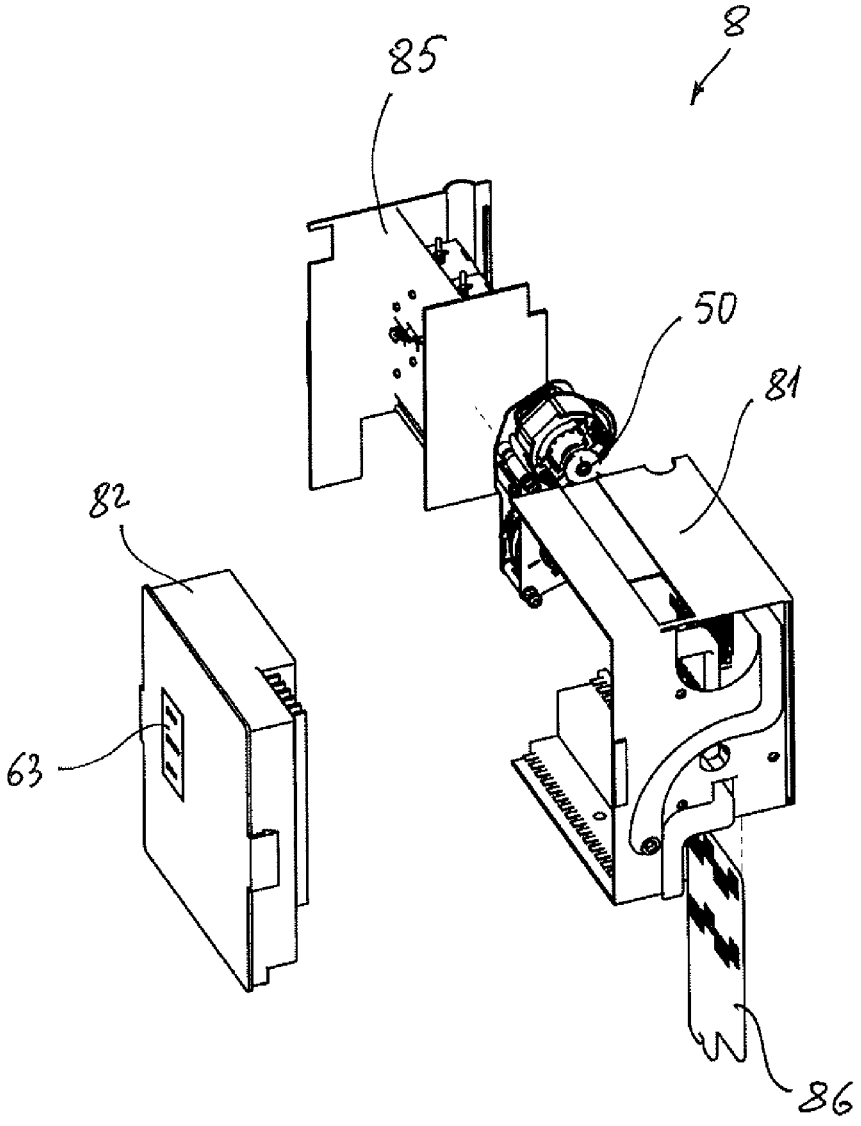
FIG. 7 is a second exploded perspective view of the control box of FIG. 5.

In such a case, as shown in the attached FIGS. 5 to 7, said local human machine interface 63 is preferably positioned on said cover 82 of said control box 8.

For what concerns the typology of the auxiliary devices 50, 51, 52, 53, 54, 55 and 86, a great variety thereof can be housed inside the control box 8.

For instance, said auxiliary devices 50, 51, 52, 53, 54, 55 and 86 can comprise one or more coils 51, 52, 53 and 54 and/or one or more pairs of auxiliary contacts 86 and/or a spring charging motor 55.

As an example, said coils 51, 52, 53 and 54 can comprise one or more of the following coils: opening, closing, shunt, undervoltage or blocking coils.

According to a particularly preferred embodiment of the Medium Voltage circuit breaker according to the invention, least one of said coils 51, 52, 53 and 54 is able to run with different voltages and perform different functions. In other words, by properly controlling one or more of said coils it is possible to use said coils for different purposes, thereby minimizing the number of coils required and consequently reducing the manufacturing costs.

With reference to FIGS. 5 to 7, the control box 8 preferably comprises also an electronic device that handles the various components and allows a self-diagnostic to be carried out.

In such a case, said control box 8 preferably comprises a removable portion 82 positioned on said casing 81, said removable portion 82 comprising an electronic board including diagnostic and control electronics.

The presence of diagnostic and control electronics allows to perform a number of functions, such as: control of the trip coils, control of the spring charging motor, control of the truck motor, detection of malfunctioning with local or remote alarms, monitoring the base parameters of the drive to determine the aging of the components thereof, interface with voltage and current sensors, etc.

It is clear from the above that medium voltage circuit breaker of the invention have a number of advantages with respect to medium voltage circuit breaker of known type.

In particular, instead of having the auxiliary devices separately assembled and wired, in the circuit breaker of the present invention the auxiliary devices are grouped together inside the casing 81 of the control box 8. The whole assembly of the control box 8 can therefore be pre-assembled and pre-tested before being positioned in the insulating base frame 2.

With the above solution it is possible to optimize the needs, e.g. minimize the number of coils, obtain a wider voltage range, have new auxiliary contacts, etc.

Also, the use of the insulating base frame 2 and of the control box 8 has a number of advantages with respect to conventional circuit breaker with an assembled base frame made of many metallic parts.

As a first advantage, the manufacturing process is greatly simplified since, in practice, the various components of the circuit breaker (interruption units, actuator, control box) are fixed to the insulating base frame 2, e.g. using screw means, said insulating base frame 2 being advantageously made in one piece.

Thus, in order to assembly the various components, it is sufficient to position the interruption units 3, 4, and 5, the actuator 6 and the control box 8 inside the insulating base frame 2. Then, fixing means, for instance screw means, can be used to fix the poles interruption units 3, 4, and 5, the actuator 6 and the control box 8 to the insulating base frame 2. The screw means can be inserted in the corresponding seats of the insulating base frame 2, from the bottom wall thereof. Therefore, the assembly process is extremely simple and can be highly automatize, thereby contributing to the reduction of the manufacturing times and costs.

In particular, as explained above, the production process for manufacturing the circuit breaker 1 is greatly simplified with respect to the conventional circuit breaker. As a matter of fact, the various sub-components of the circuit breaker (e.g. pole assembly, actuator, kinematic chain) can be pre-assembled outside the main production line of the circuit breaker. The sub-components are then fixed to the insulating base frame in a very quick and highly automatized way.

The medium voltage circuit breaker thus conceived may undergo numerous modifications and come in several variants, all coming within the scope of the inventive concept. Moreover, all the component parts described herein may be substituted by other, technically equivalent elements. In practice, the component materials and dimensions of the device may be of any nature, according to need and the state of the art.

The invention claimed is:

1. A Medium Voltage circuit breaker wherein it comprises an insulating base frame supporting:

a pole assembly having, for each phase, an interruption unit housing a fixed contact and a movable contact reciprocally couplable/uncouplable between an open and a closed position;

an actuator to actuate the opening and closing operation of said circuit breaker; and, a control and diagnostic unit comprising a control box having a casing housing a plurality of accessory devices of said circuit breaker;

wherein said pole assembly, said actuator and said control box housing are pre-assembled and then mechanically fixed to said insulating base frame at one side of said insulating base frame;

wherein said control box comprises an insulated casing, which is separated from said insulating base from and a cover that configured to couple with said insulating casing to define an enclosed environment for the accessory device;

wherein said control box comprised co-molded wirings and connections in said insulating frame, into which the accessory devices can be plugged and unplugged;

wherein said control box comprises at least a co-molded connection of a plug-socket type for connection with a corresponding at least a co-molded connection of the plug-socket type, which is comprised in said insulating frame.

2. The Medium Voltage circuit breaker according to claim 1, wherein said control box comprises a mechanical connection with said actuator.

3. The Medium Voltage circuit breaker according to claim 1, wherein said control box comprises a local human machine interface for signaling the status and/or malfunctioning conditions of said circuit breaker.

4. The Medium Voltage circuit breaker according to claim 3, wherein said control box comprises a local human machine interface for signaling the status and/or malfunctioning conditions of said circuit breaker, and wherein said local human machine interface is positioned on said cover of said control box.

5. The Medium Voltage circuit breaker according to claim 1, wherein said accessory devices comprises one or more coils and/or one or more pairs of auxiliary contacts and/or a spring charging motor.

6. The Medium Voltage circuit breaker according to claim 5, wherein said coils comprises one or more of the following coils: opening, closing, shunt, undervoltage or blocking coils.

7. The Medium Voltage circuit breaker according to claim 5, wherein at least one of said coils is able to run with different voltages and perform different functions.

8. The Medium Voltage circuit breaker according to claim 1, wherein said control box comprises a removable portion positioned inside on casing and comprising an electronic board including diagnostic and control electronics.

9. The Medium Voltage circuit breaker according to claim 1, wherein said control box comprises a mechanical connection with said actuator.

10. The Medium Voltage circuit breaker according to claim 1, wherein said control box comprises a mechanical connection with said actuator.

* * * * *